United States Patent [19]

Suwa

[11] Patent Number: 4,750,528

[45] Date of Patent: Jun. 14, 1988

[54] FAULTY WEFT REMOVER FOR A FLUID JET LOOM

[75] Inventor: Mituru Suwa, Kanazawa, Japan

[73] Assignee: Tsudakoma Kogyo Kabushiki Kaisha, Japan

[21] Appl. No.: 69,009

[22] Filed: Jul. 1, 1987

[30] Foreign Application Priority Data

Jul. 4, 1986 [JP] Japan ..... 61-158578
Jul. 10, 1986 [JP] Japan ..... 61-163180

[51] Int. Cl.[4] ..... D03D 47/08
[52] U.S. Cl. ..... 139/116; 139/429
[58] Field of Search ..... 139/116, 1 R, 435, 450, 139/452, 429

[56] References Cited

U.S. PATENT DOCUMENTS 4,502,512 3/1985 Suzuki et al. ..... 139/116
4,635,686 1/1987 Terasaki ..... 139/435
4,664,157 5/1987 Shin ..... 139/116
4,688,606 8/1987 Tamatani ..... 139/116

*Primary Examiner*—Henry S. Jaudon
*Attorney, Agent, or Firm*—Lerner, David, Littenberg, Krumholz & Mentlik

[57] ABSTRACT

In construction of a faulty weft remover for a fluid jet loom equipped with a rotary take-up drum and a reciprocal cutter assembly, a common drive source is provided for selective, phased and independent driving of the take-up drum and the cutter assembly is configurated to automatically distribute a faulty weft wound on the take-up drum into separate groups so that phased operation of the take-up drum and the cutter assembly should be curried out reliably with high degree of success in faulty weft severance by a simplified construction.

11 Claims, 8 Drawing Sheets

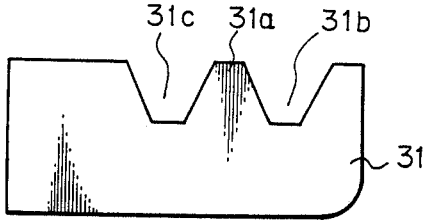
Fig. 7A
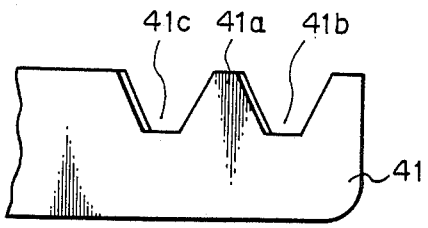
Fig. 7B
Fig. 8A
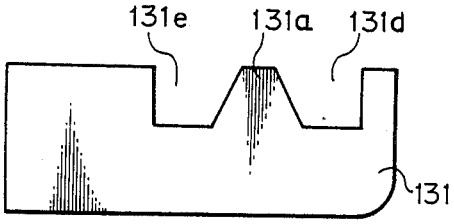
Fig. 8B
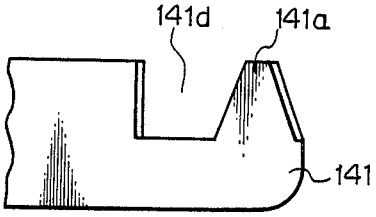

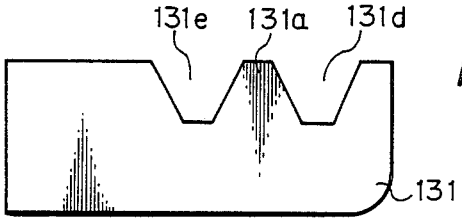
Fig. 9A
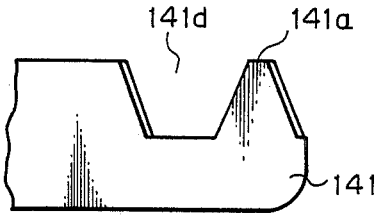
Fig. 9B
Fig. 10A
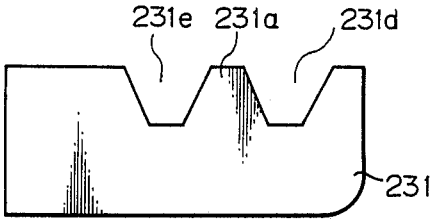
Fig. 10B
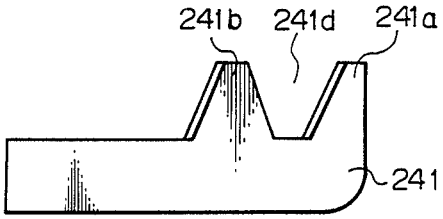

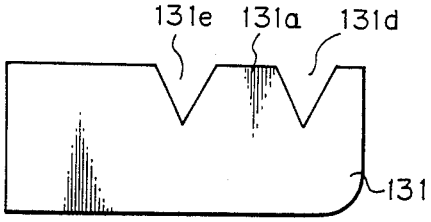
Fig. 11A
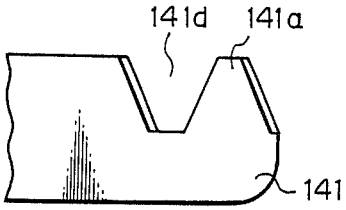
Fig. 11B
Fig. 14A
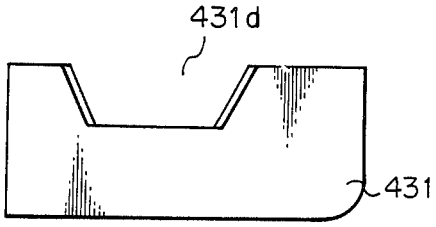
Fig. 14B
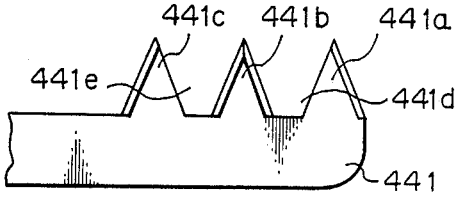

FAULTY WEFT REMOVER FOR A FLUID JET LOOM

BACKGROUND OF THE INVENTION

The present invention relates to a faulty weft remover for a fluid jet loom, and more particularly relates to improvement in construction of a weft remover provided with a take-up drum in combination with a cutter assembly on a fluid jet loom.

At occurrence of faulty weft insertion on a fluid jet loom, a faulty weft, i.e., a unsuccessfully inserted weft has to be removed from the shed for repair of weaving defect generated by the faulty weft insertion.

Japanese Patent Opening Sho. No. 59-21757 discloses an automatic faulty weft remover to this end. This proposed remover includes a separator assembly for separating a faulty weft from a woven cloth and a drawer assembly for drawing the faulty weft assigned by the separator assembly out of the shed. In the case of this remover, removal of a faulty weft is based on cooperation of the two assemblies and any small misstep in the phased cooperation of the two assemblies is apt to cause failure in assignment of the faulty weft between the two assemblies. In addition, use of the two separate assemblies causes rise in production and maintenance costs.

In view of the drawbacks of this prior art, a new remover was proposed by the applicant of the present invention in Japanese Patent Application Sho. No. 61-16166. This new remover includes a take-up drum in combination with a cutter assembly. A faulty weft is first caught by a catcher pin attached to the take-up drum to be wound on the take-up drum. Next, the cutter assembly severs the faulty weft wound on the take-up drum. Absence of inter-assembly weft assignment assures high operational reliability. The united construction well reduces production and maintenance costs. Despite these merits, this remover is still accompanied with several drawbacks. First, the take-up drum and the cutter assembly have different drive sources. Use of the double drive sources requires exact phase adjustment in operation. Second, great deal of weft is wound on the take-up drum when a faulty weft is relatively long. Presence of such great deal of faulty weft on the take-up drum tends to cause unsuccessful severance by the cutter assembly. Such a malfunction also tends to start when a filament yarn is used for the weft.

SUMMARY OF THE INVENTION

It is the one object of the present invention to provide a faulty weft remover which requires no complicated phase adjustment in operation between a take-up drum and a cutter assembly.

It is another object of the present invention to provide a faulty weft remover which assures successful weft severance regardless of the amount of a faulty weft on a take-up drum and the type of the yarn used for the weft.

In accordance with the present invention, a take-up drum and a cutter assembly are operationally coupled to a common drive source in such an arrangement that the take-up drum and cutter assembly are rotated on forward rotation of the drive source and the cutter assembly is driven linearly at reverse rotation of the drive source, the cutter assembly having a construction to distribute the faulty weft to be wound on the take-up drum into two separate groups.

DESCRIPTION OF THE PREFERRED EMBODIMENTS

Figure 1:
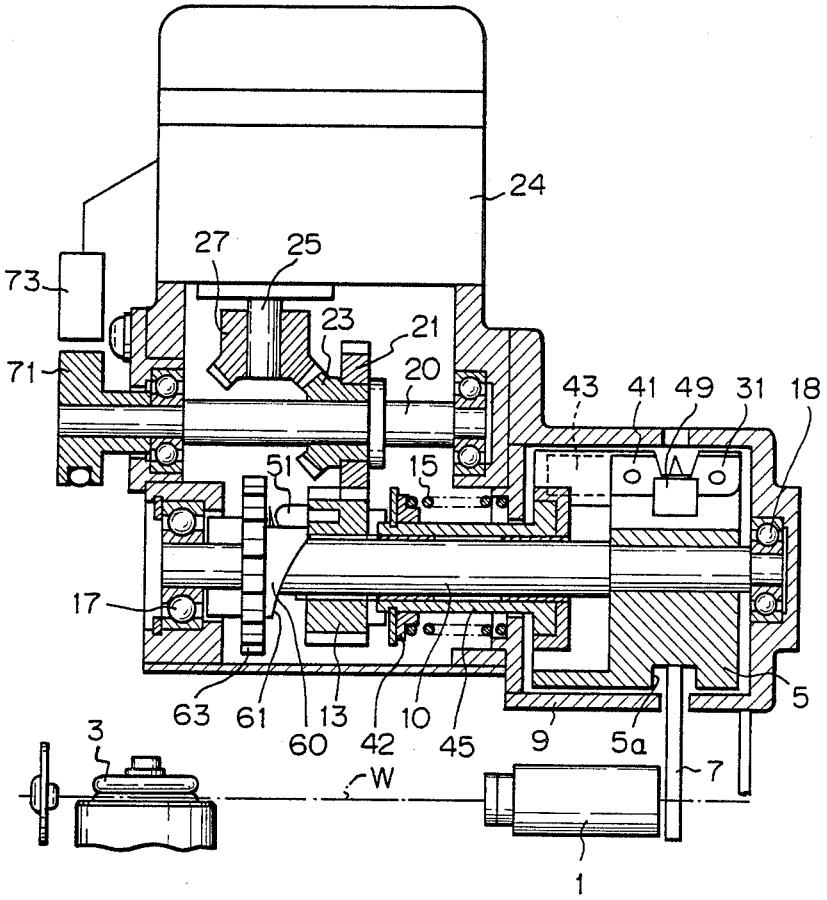
FIG. 1 is a sectional side view of one embodiment of the faulty weft remover in accordance with the present invention.
Figure 2:
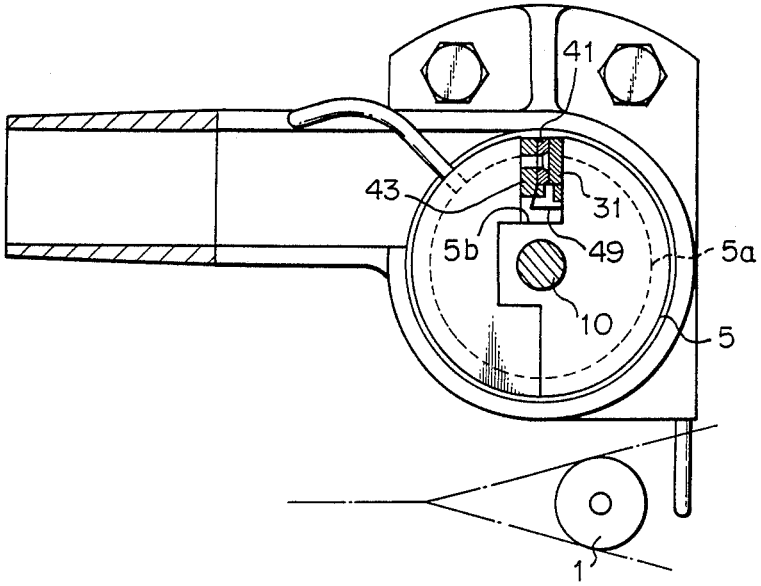
FIG. 2 is a sectional front view of a part of the remover shown in FIG. 1, FIGS. 3 and 4 are side views, partly in section, of one embodiment of the cutter assembly used for the remover shown in FIG. 1.

One embodiment of the remover of the present invention is shown in FIGS. 1 and 2, in which a take-up drum 5 is arranged above the section of a weft W extending between a main nozzle 1 and the selvage of a woven cloth (not shown).

The take-up drum 5 is securely mounted on a main shaft 10 extending in parallel to the running direction of the weft W. The main shaft 10 is rotatably mounted via a bearing 17 and a bearing 18 to a causing 9 which is secured to a proper framework not shown of a fluid jet loom. Spaced rearwards apart from the take-up drum 5, a slide gear 13 is mounted to the main shaft 10 in an axially slidable arrangement. As later described in more detail, the slide gear 13 is normally pushed rearwards by means of a compression spring 15. An intermediate shaft 20 is rotatably mounted to the casing 9 in parallel to the main shaft 10 whilst extending in the running direction of the weft W. A drive motor 24 is mounted atop the casing 9 and has an output shaft 25 on which a drive bevel gear 27 is secured. This drive bevel gear 27 is in a meshing engagement with a driven bevel gear 23 secured on the intermediate shaft 20. A drive gear 21 is secured on the boss of the driven bevel gear 23 in a meshing engagement with the slide gear 10.

The drive motor 24 is reversible in rotation depending on control signals accepted. For removal of a faulty weft, the drive motor 24 transmits its rotation to the main shaft 10 via the gears 27, 23, 21, 13, the pin 51 and the cam 60, thereby rotating the take-up drum 5 in a direction to separate the faulty weft from the woven fabric. In FIG. 2, for example, the take-up drum 5 rotates in the counterclockwise direction.

A circumferential groove **5*a* is formed in the take-up drum 5 and a catcher pin 7 is secured at its proximal end to the bottom of the circumferential groove 5*a*. As best seen in FIG. 2, the catcher pin 7 is bent somewhat in the rotating direction of the take-up drum 6 for removal of a faulty weft. The size of the catcher pin 7 is selected so that, as the take-up drum rotates, the catcher pin 7 should scoop the weft W at the section extending between the main nozzle 1** and the selvage of the woven cloth.

Figure 3:
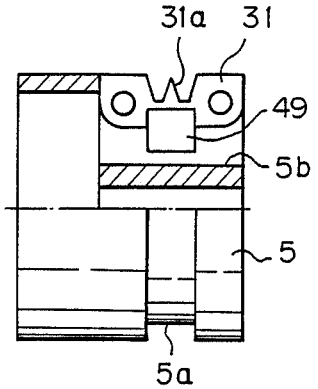
Figure 4:
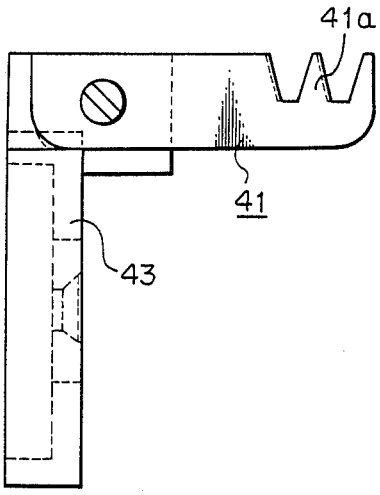

A longitudinal groove **5*b* is also formed in the take-up drum 5 extending normal to the circumferential groove 5*a*. As shown in FIGS. 2 and 3, a stationary cutter 31 is fixed to one side wall of the longitudinal groove 5*b* astride the intersection of the both grooves 5*a* and 5*b*. As shown in FIG. 4, a movable cutter 41 is also slidably accommodated in the longitudinal groove 5***b* whilst being pressed side by side against the stationary cutter 31 by a reaf spring 49. More specifically as shown in FIGS. 7A and 7B, the stationary cutter 31 is provided with fore and rear gullets 31*b* and 31*c* intervened by a center point 31*a*. Similarly, the movable cutter 41 is provided with fore and rear gullets 41*b* and 41*c* intervened by a center point 41*a*. In this case, however, the fore edge of the center point 41*a* and the rear edge of the rear gullet 41*c* are provided with blades.

Figure 6:
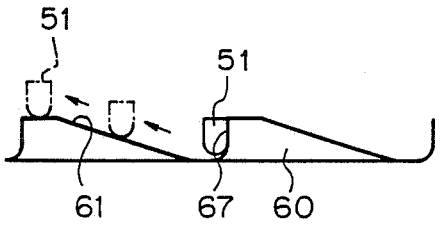
FIG. 6 is a diagram for explaining the operation of a cam used for the remover shown in FIG. 1, and FIGS. 7A to 14B are simplified side views of various embodiments of the cutter assembly preferably used for the remover shown in FIG. 1.

The movable cutter 41 is coupled via a bracket 43 to a cutter shaft 45 which is axially slidably inserted over the main shaft 10. The above-described compression spring 15 is interposed between a spring seat 42 secured on the cutter shaft 45 and the casing 9. Due to the repulsion of the compression spring 15, the rear end of the cutter shaft 45 is normally kept, via a slip ring, in pressure contact with the fore face of the slide gear 13. On the rear side of the slide gear 13, is a cam 60 secured to the main shaft 10 and provided with a cam face 61 in contact with a pin 51 projecting from the rear face of the slide gear 13. The relationship between the pin 51 and the cam face 61 of the cam 60 is shown in FIG. 6.

Figure 5:
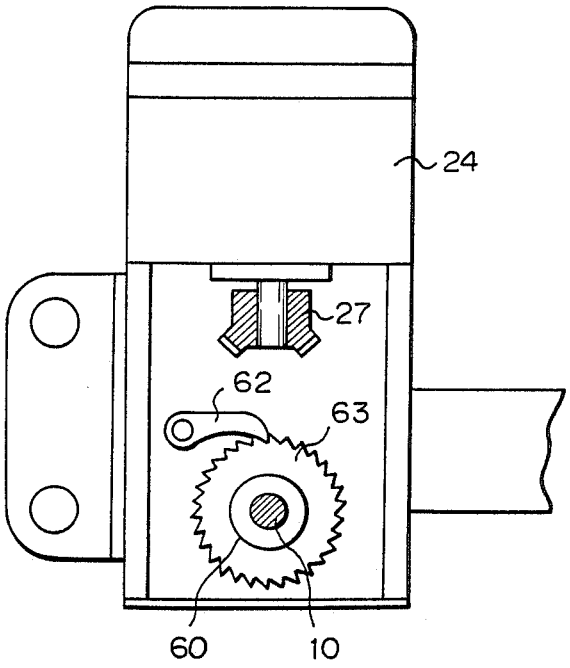
FIG. 5 is a sectional rear view of a part of the remover shown in FIG. 1.

On the rear side, the cam 60 is accompanied in one body with a ratchet wheel 63. As shown in FIG. 5, this ratchet wheel 63 is controlled by a ratchet 62 so that the main shaft 10 should be allowed to rotate in one direction only. That is, the main shaft 10 is allowed to rotate only when the drive motor 24 rotates in the normal direction. When the drive motor motor 24 rotates in the reverse direction, the main shaft 10 is locked against rotation by the ratchet 62.

At the rear end, the intermediate shaft 20 is provided with a radial dog 71 which is faced by a proximity switch 73. By an output signal from this proximity switch 73, is fixed the stop position of the take-up drum 5, i.e. the position at which a faulty weft wound on the take-up drum 5 should be severed.

The operation of the faulty weft remover of the above-described construction will now be explained.

During normal weaving operation of the loom, the weft is delivered to the main nozzle 1 for weft insertion from a weft reservoir (not shown) via a clamper 3 in the open state.

When a faulty weft is produced by faulty weft insertion, a stop signal is issued by a weft detector (not shown) on the loom. This stop signal makes a weft cutter (not shown) inactive and closes the clamper 3 in order to provisionally prohibit further delivery of weft from the weft reservoir. Thus, the faulty weft is not cut, the next weft insertion is canceled, and the loom performs one more cycle of inertia rotation to stop. As a consequence, the faulty weft under this condition extends between the main nozzle 1 and the selvage of the woven cloth.

Next, the loom is rotated reversely to a crank angle of about 180 degrees for free release of the faulty weft. During this procedure, the weft reservoir is provisionally kept inactive and the clamper 3 open.

After this procedure, the drive motor 24 is driven for rotation in the normal direction. This rotation of the drive motor 24 is transmitted to the slide gear 13 via the gears 27, 23 and 21. Then the pin 51 on the slide gear 13 abuts against the cam face 67 of the cam 60 whic is thereupon driven for rotation. Then the main shaft 10 is also driven for rotation so that the faulty weft should be caught by the catcher pin 7 to be wound on the take-up drum 5. Concurrent rotation of the dog 71 on the intermediate shaft 20 is constantly watched by the proximity switch 73 which is electrically connected to the drive motor 24.

Full removal of the faulty weft is thus detected through the extent of rotation of the intermediate shaft 20 by the proximity switch 73 facing the dog 71 and, on receipt of a corresponding signal from the proximity switch 73, the drive motor 24 is driven for rotation in the reverse direction and the slide gear 13 rotates in the reverse direction too. As a substitute of the dog-switch combination for detection of the full removal, degree of rotation of the drive motor 24 in the normal direction may be detected for issue of a corresponding signal. As a further substitute, presence of the faulty weft may be detected between the main nozzle 1 and the selvage of the woven cloth.

Despite rotation of the slide gear 13 in the reverse direction, the cam 60 is locked against accompanying rotation by the ratchet 62 shown in FIG. 5. As a consequence, the pin 51 on the slide gear 13 moves from the position shown with solid lines to a position shown with dot lines in FIG. 6. As a result, the slide gear 13 is urged to move towards the take-up drum 5 against the repulsion by the compression spring 15. Then, the cutter shaft 45 also moves towards the take-up drum 5 in order to move the movable cutter 41 forwards across the circumferential groove 5*a* via the bracket 43. Following this linear movement of the movable cutter 41, the blade on the fore edge of the center point 41*a* severs the section of the faulty weft in the fore gullet 31*b* of the stationary cutter 31 (see FIGS. 7A and 7B) whereas the blade on the rear edge of the rear gullet 41C severs the section of the faulty weft in the rear gullet 31*c* of the stationary cutter 31. Full severance of the faulty weft is again detected through rotation of the intermediate shaft 20 by the proximity switch 73 facing the dog 71 and on receipt of a corresponding signal from the proximity switch 73, the drive motor 24 ceases its rotation in the reverse direction. As the moment, the pin 51 returns to the position shown with the solid lines in FIG. 6.

Since the take-up drum 5 on the main shaft 10 is locked against rotation in the reverse direction during this procedure by the rachet 62 (see FIG. 5), the faulty weft on the take-up drum 5 can be reliably severed by the cutter assembly without slack.

So that a remainder of weft connected to the main nozzle 1 after the severance should be of an optimum length, the angular position of the take-up drum 5 can be duly adjusted by changing the relative position between the proximity switch 73 and the dog 71 on the intermediate shaft 20.

In the case of the embodiment shown in FIG. 1, the ratchet 62 is used for locking the cam 60 against rotation in the reverse direction. This operation can be done by use of a proper one-way clutch. Further, an electromagnetic brake may be used for locking the main shaft 10, i.e. the cam 60, against rotation in the reverse direction.

In a modification, the pin 51 may be secured to the fore face of the ratchet wheel 63 and the cam 60 may be arranged on the rear side of the slide gear 13.

More broadly, the pin-cam combination may be replaced by a known proper mechanism for converting a rotary movement into a linear movement.

In accordance with the present invention, driving of the take-up drum and the cutter assembly by a single, common drive source removes the need for phase adjustment in operation. Further, since the faulty weft wound on the take-up drum is distributed into separate groups by the specified configuration of the stationary cutter and different groups are severed by different blades on the movable cutter, severance of the faulty weft can be reliably carried out regardless of the amount and/or type of the faulty weft.

It will be well understood that the stationary cutter 31 shares distribution of a faulty weft and the movable cutter 41 shares severance of the faulty weft in the case of the above-described embodiment. In general, the cutter assembly used for the present invention is classified into two major types. In the case of the first type, the stationary cutter shares distribution of a faulty weft and the movable cutter shares severance of the faulty weft. In the case of the second type, the stationary cutter shares severance of a faulty weft and the movable cutter shares distribution and severance of the faulty weft.

Apparently, the cutter assembly shown in FIGS. 7A and 7B belongs to the first type. A cutter assembly shown in FIGS. 8A and 8B is a slight modification. A stationary cutter 131 is provided with a center point 131*a*, and fore and rear gullets 131*d* and 131*e*. A movable cutter 141 is provided with a fore point 141*a* having a fore edge blade and a rear gullet 141*d* having a rear edge blade. During forward movement of the movable cutter 141, the section of the faulty weft in the fore gullet 131*d* is severed by the blade on the fore point 141*a* and the section of the faulty weft in the rear gullet 131*e* is severed by the blade on the rear edge of the rear gullet 141*d*. Except for the shape of the gullets, the cutter assembly in FIGS. 9A and 9B is substantially similar to that shown in FIGS. 8A and 8B.

The faulty weft may be severed during rearward movement of a movable cutter by properly adjusting the relative position between stationary and movable cutters. One example is shown in FIGS. 10A and 10B. In this case, a stationary cutter 231 is provided with center point 231a, and fore and rear gullets 231*d* and 231*e*. A movable cutter 241 is provided with a fore point 241*a* with a blade on its rear edge, a rear point 241*b* with a blade on its rear edge, and a center gullet 241*d* intervening the fore and rear points. During rearward movement of the movable cutter 241, the section of the faulty weft in the fore gullet 231*d* is severed by the blade on the rear edge of the fore point 241*a* whereas the section of the faulty weft in the rear gullet 231*e* is severed by the blade on the rear edge of the rear point 241*b*. Except for the shapes of the point and gullets, the cutter assembly in FIGS. 11A and 11B is substantially similar to that shown in FIGS. 9A and 9B.

Figure 12A:
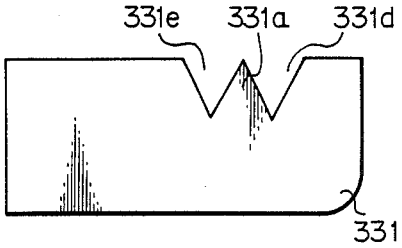
Figure 12B:
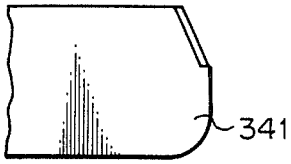

The other cutter assemblies are shown in FIGS. 12A to 12E. In this case, a common stationary cutter 331 in FIG. 12A is used in combination with various movable cutters. That is, the stationary cutter 331 is provided with a center point 331*a* and fore and rear gullets 331*d* and 331*e*. A movable cutter 341 in FIG. 12B is provided with a blade on its fore edge only.

Figure 12C:
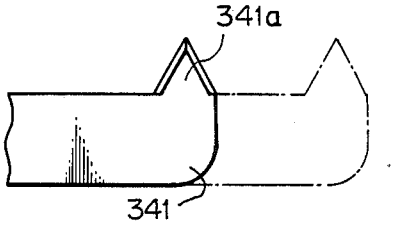
Figure 12D:
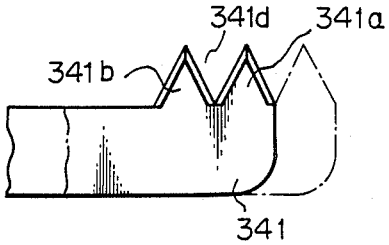
Figure 12E:
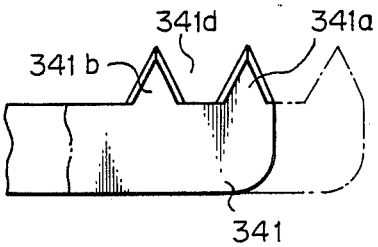

A movable cutter 341 is FIG. 12C is provided with a fore point 341*a* with blades on its fore and rear edges. In this case, severance of faulty weft is carried out twice during one cycle reciprocation of the movable cutter 341 in order to further enhance reliability in operation. Further improvement in operation is found in use of a movable cutter 341 shown in FIGS. 12D and 12E. For example in FIG. 12D, the movable cutter 341 is provided with fore and rear points 341*a* and 341*b* intervened by a center gullet 341*d*. Each point is provided with blades on its fore and rear edges. When compared with the one shown in FIG. 12C, the stroke of the movable cutter 341 shown in FIG. 12D or 12E for one reciprocation is half as shown with chain lines.

Cutter assemblies of the second type are shown in FIGS. 13A through 14B. In this case, the stationary cutter shares severance and the movable cutter shares distribution and severance. A stationary cutter 431 in FIG. 14A is substantially similar to that in FIG. 13A except for the shape of the gullet. That is, the stationary cutter 431 is provided with a relatively broad center gullet 431*d* having blades on its fore and rear edges.

Figure 13A:
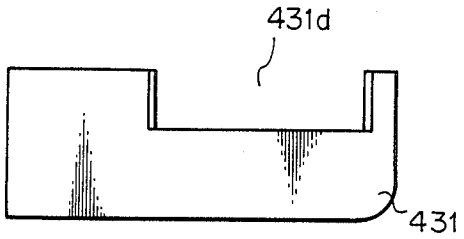
Figure 13B:
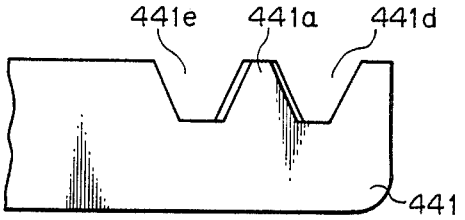

In FIG. 13B, a movable cutter 441 includes fore and rear gullets 441*d* and 441*e* intervened by a center point 441*a* which is provided with blades on its fore and rear edges. During forward movement of the movable cutter 441, the section of the faulty weft in the fore gullet 441*d* is severed by cooperation of the blade on the fore edge of the center point 441*a* of the movable cutter 441 with the blade on the fore edge of the center gullet 431*d* of the stationary cutter 431. Whereas, during rearward movement of the movable cutter 441, the section of the faulty weft in the rear gullet 441*e* is severed by cooperation of the blade one the rear edge of the center point 441*a* of the movable cutter 441 with the blade on the rear edge of the center gullet 431*d* of the stationary cutter 431. In this case, cooperation between different blades on different cutters provides a sort of shearing effect at severance, thereby greatly enhancing operational reliability of the cutter assembly.

Figure 13C:
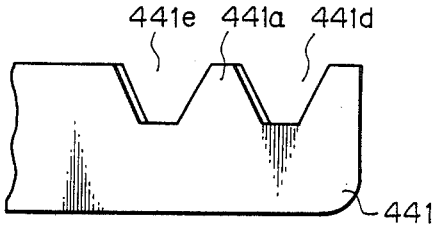

In the case of the movable cutter 441 shown in FIG. 13C, blades are formed on the fore edge of the center point 441*a* and on the rear edge of the rear gullet 441*e*. During forward movement of the movable cutter 441, the section of the faulty weft in the fore gullet 441*d* is first severed by cooperation of the blade on the fore edge of the center point 441*a* of the movable cutter 441 with the blade on the fore edge of the center gullet 431*d* of the stationary cutter 431. Next, the section of the faulty weft in the rear gullet 441*e* is severed by cooperation of the blade on the rear edge of the rear gullet 441*e* of the movable cutter 441 with the blade on the fore edge of the center gullet 431*d* of the stationary cutter 431. Here again, a sort of shearing effect can be expected at severance.

For reduction in stroke for one reciprocation, a movable cutter 441 in FIG. 14B includes fore, center and rear points 441*a*–441*c* and fore and rear gullets 441*d* and 441*e*. The fore point 441*a* has a blade on its fore edge, the center point 441*b* has blades on its fore and rear edges and the rear point 441*c* has a blade on its rear edge.

I claim:

1. An improved faulty weft remover for a fluid jet loom comprising a casing mounted to a framework of said loom, a main shaft rotatably mounted to said casing, a take-up drum coaxially secured to said main shaft and adapted for receiving a faulty weft on its circumference, a catcher pin radially extending from said take-up drum in an arrangement to catch said faulty weft on normal rotation of said take-up drum, a cutter assembly mounted in axial direction to said take-up drum and including stationary and movable cutters which cooperate to sever said faulty weft wound on said take-up drum, a reversible drive source, means for selectively transmitting normal rotation of said drive source to said main shaft, means for converting reverse rotation of said drive source into a linear movement of said movable cutter of said cutter assembly for severance of said faulty weft, and means for controlling the mode and extent of rotation of said drive source in response to occurrence of faulty weft insertion and severance of said faulty weft.

2. An improved faulty weft remover as claimed in claim 1 in which said selectively transmitting means includes means for inhibiting transmission of said reverse rotation of said drive source to said main shaft.

3. An improved faulty weft remover as claimed in claim 2 in which said inhibiting means includes a ratchet wheel coaxially secured to said mainshaft and a ratchet mounted to said casing in engagement with said ratchet wheel in an arrangement to lock said ratchet wheel against rotation at reverse rotation of said drive source.

4. An improved faulty weft remover as claimed in claim 1 in which said selectively transmitting means includes means for disconnecting said main shaft from said drive source at said reverse rotation of said drive source.

5. An improved faulty weft remover as claimed in claim 4 in which said disconnecting means includes a one-way clutch coupled to said main shaft.

6. An improved faulty weft remover as claimed in claim 1 in which said converting means includes a cam coaxially secured to said main shaft and having a curved cam face, a pin coaxially supported by said main shaft in a fixed relationship to said cutter shaft, and means for keeping said pin in resilient engagement with said cam face of said cam.

7. An improved faulty weft remover as claimed in claim 1 in which said controlling means includes a dog synchronized in rotation with said drive source, and a proximity switch arranged facing said dog.

8. An improved faulty weft remover as claimed in claim 1, 2, 4 or 6 in which said stationary cutter of said cutter assembly includes a pair of gullets intervened by a center point in the area of said circumferential groove in said take-up drum, and said movable cutter includes at least one edge blade.

9. An improved faulty weft remover as claimed in claim 1, 2, 4 or 6 in which said stationary cutter of said cutter assembly includes a gullet with at least one edge blade in the area of said circumferential groove in said take-up drum, and said movable cutter includes a pair of gullets intervened by a center point and provided with at least two edge blade in the area of said circumferential groove.

10. An improved faulty weft remover as claimed in claim 1 in which said take-up drum has a circumferential groove receptive of said faulty weft, and said cutter assembly is arranged astride said circumferential groove in said take-up drum.

11. An improved faulty weft remover as claimed in claim 1 in which said converting means includes a cam secured to said main shaft and a pin arranged, in engagement with said cam, comovably with said movable cutter of said cutter assembly.

* * * * *

UNITED STATES PATENT AND TRADEMARK OFFICE

CERTIFICATE OF CORRECTION

PATENT NO. : 4,750,528

DATED : June 14, 1988

INVENTOR(S) : Mituru Suwa

It is certified that error appears in the above-identified patent and that said Letters Patent is hereby corrected as shown below:

Column 2, line 29, "causing" should read --casing--.
Column 2, line 57, "6" should read --5--.
Column 3, line 64, "whic" should read --which--.
Column 4, line 26, "forwards" should read --linearly--.

Signed and Sealed this

Twenty-second Day of November, 1988

*Attest:*

DONALD J. QUIGG

*Attesting Officer*

*Commissioner of Patents and Trademarks*